US007568468B2

(12) United States Patent
Wolber et al.

(10) Patent No.: US 7,568,468 B2
(45) Date of Patent: Aug. 4, 2009

(54) METHOD FOR OPERATING AN INTERNAL COMBUSTION ENGINE

(75) Inventors: Jens Wolber, Gerlingen (DE); Thomas Frenz, Noerdlingen (DE); Karsten Hinn, Giessen (DE); Timm Hollmann, Ludwigsburg (DE); Christian Wiedmann, Ludwigsburg (DE); Stefan Smetana, Ludwigsburg (DE); Laurent Nack, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 653 days.

(21) Appl. No.: 10/813,853

(22) Filed: Mar. 31, 2004

(65) Prior Publication Data

US 2004/0250794 A1 Dec. 16, 2004

(30) Foreign Application Priority Data

Apr. 4, 2003 (DE) ..... 103 15 318

(51) Int. Cl.
*F02M 57/02* (2006.01)

(52) U.S. Cl. ..... 123/446; 123/447; 123/510; 123/541

(58) Field of Classification Search ..... 123/467, 123/198 D, 456, 299, 300, 541, 516, 510, 123/506, 446, 447
See application file for complete search history.

(56) References Cited

U.S. PATENT DOCUMENTS 5,197,438 A * 3/1993 Kumano et al. ..... 123/506
5,678,521 A * 10/1997 Thompson et al. ..... 123/447
6,095,118 A * 8/2000 Klinger et al. ..... 123/446
6,546,918 B2 * 4/2003 Onishi et al. ..... 123/506
6,666,020 B2 * 12/2003 Tonetti et al. ..... 60/286
6,668,800 B2 * 12/2003 Ricco et al. ..... 123/446
6,694,950 B2 * 2/2004 Djordjevic ..... 123/446
6,745,751 B2 * 6/2004 Seo et al. ..... 123/456
6,769,414 B2 * 8/2004 Rembold et al. ..... 123/514
6,772,738 B2 * 8/2004 Rembold et al. ..... 123/514
6,889,657 B2 * 5/2005 Ruesseler et al. ..... 123/446
6,899,084 B2 * 5/2005 Miyashita ..... 123/446
7,107,968 B2 * 9/2006 Nomura ..... 123/456
7,201,147 B2 * 4/2007 Bernhardt et al. ..... 123/446

(Continued)

FOREIGN PATENT DOCUMENTS

DE 195 39 885 11/1996

(Continued)

*Primary Examiner*—Stephen K Cronin
*Assistant Examiner*—J. Page Hufty
(74) *Attorney, Agent, or Firm*—Kenyon & Kenyon LLP

(57) ABSTRACT

A method for operating an internal combustion engine having a fuel pump with a drive shaft is provided, the fuel pump conveying fuel into at least one fuel-collection line, the fuel being subsequently conveyed to at least one combustion chamber via at least one fuel-injection device. In the method, a quantity of the fuel conveyed by the fuel pump into the fuel-collection line is set by means of a valve device. The valve device is configured to selectively connect a discharge side of the fuel pump to a low-pressure region of the fuel pump (during deactivation phase), and selectively disconnect the discharge side from the low-pressure region (during supply phase). In supplying the quantity of fuel, a supply rate, defined as the number of supply phases of the fuel pump per rotation of the drive shaft, is determined as a function of at least one operating parameter of the internal combustion engine.

10 Claims, 6 Drawing Sheets

U.S. PATENT DOCUMENTS

2001/0027769 A1* 10/2001 Mizuno et al. ..... 123/295
2002/0157646 A1* 10/2002 Hiraku et al. ..... 123/456
2003/0089339 A1* 5/2003 Schueler ..... 123/446
2003/0217734 A1* 11/2003 Ito et al. ..... 123/299
2006/0000446 A1* 1/2006 Ricco et al. ..... 123/446

FOREIGN PATENT DOCUMENTS

DE 197 31 102 2/2003

* cited by examiner

Control & Regulating Device 44
Memory 46
Mi
Fuel Quantity
PR
Pressure
Sensor 42
Fuel Collection Line 28
Temperature
T
N
Angle
Sensor 40
Sensor 38
30
32
Fuel-Injection Devices
Combustion Chambers 32
Crankshaft 34
10 Engine
Electromagnet 27
Quantity-Control Valve 26
Check Valve 24
Supply Unit 22
Drive Shaft 36
Check Valve 20
High-Pressure Fuel Pump 18
Electric Fuel Pump 16
Fuel Tank 14
Fuel System 12

METHOD FOR OPERATING AN INTERNAL COMBUSTION ENGINE

FIELD OF THE INVENTION

The present invention relates to a method for operating an internal combustion engine, and relates more particularly to a method in which the quantity of fuel supplied into the fuel collection line is adjusted by a valve device.

BACKGROUND INFORMATION

A method for adjusting the quantity of fuel supplied into a fuel collection line of a fuel-supply system for an internal combustion engine having direct fuel injection is described in published German patent document DE 195 39 885. Via a fuel line, a first, electrically-driven fuel pump supplies fuel from a fuel storage reservoir to a second high-pressure fuel pump, which is mechanically driven by the internal combustion engine. This second fuel pump in turn supplies the fuel to a plurality of fuel injectors via a fuel-collection line (rail). These fuel injectors inject the fuel directly into assigned combustion chambers.

The high-pressure fuel pump is mechanically coupled to a driven shaft of the internal combustion engine, which means the operating speed of the high-pressure fuel pump is proportional to the rotational speed of the driven shaft of the internal combustion engine, which rotational speed may differ considerably. The driven shaft may be a crankshaft or a camshaft of the internal combustion engine.

In order to be able to adjust the fuel quantity conveyed by the second fuel pump into the fuel collection line independently of the rotational speed of the internal combustion engine, an electromagnetic quantity-control valve is provided. Using the quantity control valve, a discharge side of the second fuel pump can be connected to a low-pressure side of the second fuel pump, in one switching position of the quantity control valve. In another switching position of the quantity-control valve, the connection between the discharge side and the low-pressure side is interrupted, in which case the second fuel pump pumps the fuel from its high-pressure side to the low-pressure side, i.e., no delivery into the fuel-collection line takes place.

Published German patent document DE 197 31 102 describes opening a switching valve, which is arranged in a similar manner as the previously mentioned quantity-control valve described in published German patent document DE 195 39 885, during overrun operation of the internal combustion engine. Thus, the high-pressure fuel pump does not supply fuel during overrun operation of the internal combustion engine.

SUMMARY

An object of the present invention is to provide a method in which fuel is able to be introduced into the combustion chambers of the internal combustion engine with the highest possible precision, while simultaneously ensuring a long service life and the lowest possible power consumption of the fuel pump.

In a method according to the present invention, when the fuel pump is supplying fuel, the number of supply phases of the fuel pump per rotation of the drive shaft (supply rate) is a function of at least one operating parameter of the internal combustion engine.

In accordance with the present invention, a computer program for implementing the method described above may be stored on a storage medium. In addition, an internal combustion engine may be provided with a control and/or a regulating device which is programmed for implementing the method described above.

In the method according to the present invention, the advantages of an operating method in which the fuel pump has only a low number of supply phases (only one, for example) per rotation of the drive shaft, and advantages of an operating method in which the fuel pump has a greater number (three, for example) of supply phases per rotation of the drive shaft, may be simultaneously achieved.

One advantage of a supply arrangement having a low number of supply phases per rotation of the drive shaft is that the thermal loading of the fuel pump is low. Since the fuel is heated during compression of the fuel in the fuel pump, if the discharge side of the fuel pump is connected to the low-pressure region relatively seldomly, only a comparatively small quantity of this heated fuel is returned to the low-pressure region, so that the fuel pump heats up less overall.

Furthermore, a low number of supply phases per rotation of the drive shaft results in lower energy consumption of the fuel pump, since its dead volume must be compressed less often. Given a lower number of supply phases, it is also possible to supply a larger maximum quantity per rotation of the drive shaft. This is due to the fact that the number of opening and closing phases of the valve device and compression phases is lower overall, thus leaving more time for the actual supply.

On the other hand, a higher number of supply phases of the fuel pump per rotation of the drive shaft has the advantage of providing uniformity of the supply-pressure characteristic. Consequently, fewer fluctuations occur in the fuel pressure in the fuel-collection line, thereby improving the precision in the metering of fuel into the combustion chambers. Due to the uniformity of the pressure profile in the fuel-collection line, the corresponding components are also subjected to less stress, which has a positive effect on the service life of the corresponding components.

In a first embodiment of the method according to the present invention, it is provided that the fuel supply rate be a function of an operating temperature of the internal combustion engine and/or the fuel quantity to be injected. If only a small fuel quantity is to be injected, a low supply rate may be selected, yielding corresponding advantages. On account of the low fuel quantities withdrawn from the fuel-collection line, the pressure differentials in the fuel-collection line are comparatively small between individual injections, so that the corresponding components are not unduly stressed and the precision in the metering of the injected fuel quantity is not affected to any significant degree.

Even at high operating temperatures of the internal combustion engine, a low fuel supply rate is able to be chosen so as to avoid overheating of the fuel pump. On the other hand, at normal operating temperatures of the internal combustion engine, and/or in the case of large fuel quantities to be injected, a comparatively high supply rate will be chosen in order to derive the corresponding advantages. In implementing this method, the advantages of the present invention may be obtained by evaluating the operating parameters of the internal combustion engine, which parameters are normally monitored in the course of engine operation anyway.

Furthermore, it is provided in accordance with the present invention that an interval of a first supply phase of a supply having a certain supply rate (supply-rate interval) be ascertained from the last supply phase of a preceding supply-rate interval and/or a duration of the first supply phase of a new supply-rate interval prior to the change in the supply rate.

Pressure overswings during the change from one supply rate to another supply rate are avoided in this way.

In accordance with the method according to the present invention, the middle of a last supply phase of a particular supply-rate interval is spaced apart from the middle of the first supply phase of another supply-rate interval by at least approximately one waiting angle (W) of a crankshaft of the internal combustion engine, which is calculated according to the following formula:

$$W = 720 * \frac{(X + Y)}{(2 * X * Y)}$$

where X=the supply rate prior to switching, and Y=the supply rate after switching.

This avoids a deviation of the actual pressure in the fuel-collection line from the setpoint pressure in response to a change to a larger supply rate. The above-mentioned method ensures that, approximately halfway through the first supply phase following the change, the actual pressure is roughly at the level of the setpoint pressure.

In accordance with the present invention, it is also proposed that a reduction in the supply rate be allowed only if a supply phase is permitted at an angular position of the crankshaft that corresponds to the instantaneous angular position plus the waiting angle. This takes into account the fact that supply phases will only be permitted at specific crank angles of the crankshaft of the internal combustion engine, so as to simplify the control and regulation. For example, in a single supply, i.e., when only one supply phase occurs per rotation of the drive shaft, a supply is usually permitted only at an angle of the crankshaft at which an injection into the first cylinder of the internal combustion engine takes place.

BRIEF DESCRIPTION OF THE DRAWINGS

FIG. 5 is a chart similar to the chart shown in FIG. 2, which FIG. 5 shows an increase in a supply rate of the fuel pump shown in FIG. 1.

FIG. 6 is a chart similar to the chart shown in FIG. 2, which FIG. 6 shows a reduction in the supply rate of the fuel pump shown in FIG. 1.

DETAILED DESCRIPTION

Figure 1:
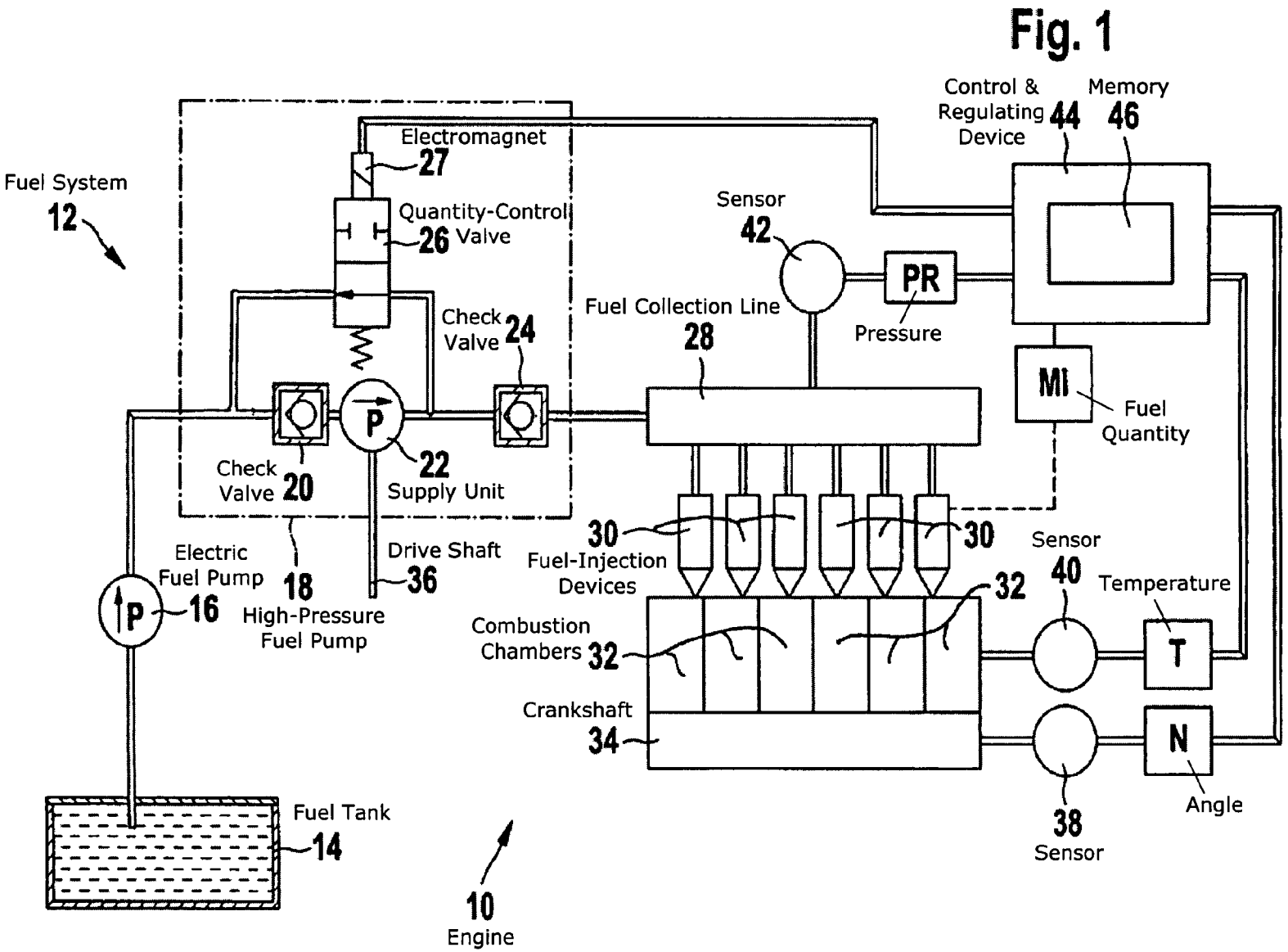
FIG. 1 is a schematic representation of an internal combustion engine having direct fuel injection, which engine includes a high-pressure fuel pump, a quantity-control valve and a fuel-collection line.

In FIG. 1, a 4-stroke internal combustion engine, denoted by reference numeral 10, powers a motor vehicle, which is not shown in FIG. 1.

Part of internal combustion engine 10 is a fuel system 12, which includes a fuel tank 14 from which an electrical fuel pump 16 supplies fuel. Electrical fuel pump 16 supplies fuel to a high-pressure fuel pump 18, which is indicated by a dot-dash line. On the intake side of pump 18, a check valve 20 is first arranged, followed by the actual supply unit 22. Another check valve 24 is positioned on the discharge side of supply unit 22. In the example shown, high-pressure fuel pump 18 is a three-cylinder radial-piston pump, of which only the components of one cylinder are shown for the sake of simplicity.

The fuel quantity supplied by high-pressure fuel pump 18 is adjusted by a quantity-control valve 26. This valve is open in its neutral position and connects the discharge side of supply unit 22 to the intake side. In a closed position of the valve, this connection is interrupted. The valve positions are changed by means of an electromagnet 27.

High-pressure fuel pump 18 supplies to a fuel-collection line 28, which is also referred to as "rail." Connected to the line 28 are a total of six fuel-injection devices 30. Fuel-injection devices 30 inject the fuel directly into their respective assigned combustion chambers 32. During operation of internal combustion engine 10, a crankshaft 34 is made to rotate. This crankshaft drives a drive shaft 36 of supply unit 22 of high-pressure fuel pump 18 in a manner not shown in more detail in FIG. 1. Two crankshaft rotations produce one rotation of the drive shaft.

The angular position of crankshaft 34 is detected by a sensor 38; the temperature of a cylinder head (not shown in detail in FIG. 1) of internal combustion engine 10 is detected by a sensor 40; and the pressure in fuel-collection line 28 is detected by a sensor 42. The signals from sensors 38, 40 and 42 are transmitted to a control and regulating device 44, which in turn triggers electromagnet 27 of quantity-control valve 26 and determines a quantity MI of the fuel to be injected. The control is implemented according to a method that is stored as computer program in a memory 46 of control and regulating device 44.

The quantity of fuel supplied to fuel-collection line 28 by high-pressure fuel pump 18 is adjusted with the aid of quantity-control valve 26. If quantity-control valve 26 is closed, the fuel is supplied to fuel-collection line 28. This phase is also known as the "supply phase." On the other hand, if quantity-control valve 26 is open, no fuel is supplied to fuel-collection line 28. Instead, the fuel is returned to the intake side, largely without pressure. This phase is also called the "deactivation phase."

In the case of the high-pressure fuel pump 18 shown in FIG. 1, it is possible to provide a plurality of supply phases or only a single supply phase for each rotation of drive shaft 36 of supply unit 22. This is determined as a function of the signals from sensors 38, 40 and 42, as well as a function of the injection quantity MI. The number of supply phases of high-pressure fuel pump 18 per rotation of drive shaft 36 is also called "supply rate" or "trigger frequency."

Figure 2:
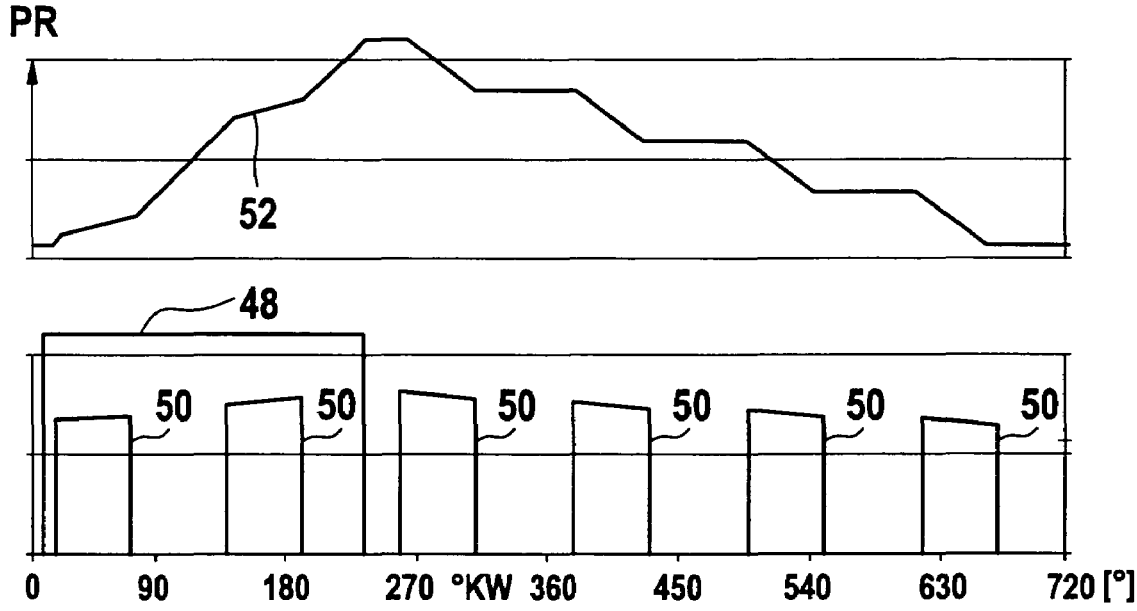
FIG. 2 is a chart showing the fuel pressure in the fuel-collection line, a supply phase of the quantity-control valve and injection phases plotted versus various crank angles in a first operating state of the internal combustion engine shown in FIG. 1.

FIG. 2 shows a first operating situation of internal combustion engine 10. In this case, only one supply phase 48 per rotation of drive shaft 36 is provided (the angular data represented in FIG. 2 and other diagrams relate to the crank angle of crankshaft 34; drive shaft 36 of high-pressure pump 18 rotates at half the rotational speed of crankshaft 34, that is to say, a crank-angular range of 720° thus corresponds to one rotation of drive shaft 36 of high-pressure fuel pump 18).

Supply phase 48 in FIG. 2 is relatively long and extends from a crank angle of approximately 10° to a crank angle of approximately 240°. The injections by one of the fuel-injection devices 30 are denoted by reference numeral 50 in FIG.

2. From the width of injection pulses 50 it can be inferred that a rather large fuel quantity MI is to be injected. The profile of pressure PR in fuel-collection line 28 is denoted by reference numeral 52. It can be gathered that, provided a constant setpoint pressure prevails in fuel-collection line 28, and with a supply rate having only one supply phase 48 per rotation of drive shaft 36, the entire fuel quantity MI injected by fuel-injection devices 30 during one working cycle must be supplied into fuel-collection line 28 during that one supply phase 48.

After supply phase 48 has ended, a relatively high fuel pressure initially results in fuel-collection line 28, which then drops considerably, to the output pressure at the beginning of supply phase 48, due to injections 50. Given large fuel quantities MI to be injected, a supply rate having a single supply phase 48 per rotation of drive shaft 36 is selected only in those cases, for instance, where sensor 40 has detected a relatively high temperature of the cylinder head of internal combustion engine 10. The rationale for this is explained below in further detail.

During a compression phase in supply unit 22, the fuel is compressed in supply unit 22. In a deactivation phase, the fuel, heated from the compression, is returned to the intake side and conveyed back to the pump. This heats the fuel even further, and high-pressure fuel pump 18 heats up as well. High-pressure fuel pump 18 is usually situated in the immediate vicinity of the cylinder head. If the cylinder-head temperature T is relatively high as well, it may easily happen that a critical temperature is reached at which high-pressure fuel pump 18 may be damaged.

The supply of warm fuel may also result in an impermissible temperature increase in fuel-collection line 28, in the fuel-injection devices 30 and, finally, in the cylinder head as well. This is prevented if a low supply rate having only one supply phase 48, and thus only one deactivation phase per rotation of drive shaft 38, is selected when cylinder-head temperatures T are high.

However, it may also be gathered from FIG. 2 that the pressure in fuel-collection line 28 fluctuates considerably during a working cycle of internal combustion engine 10, so that different pressures prevail in fuel-collection line 28 during the individual injections of fuel into combustion chambers 32. This reduces the accuracy in the metering of the desired fuel quantity into combustion chambers 32.

Figure 3:
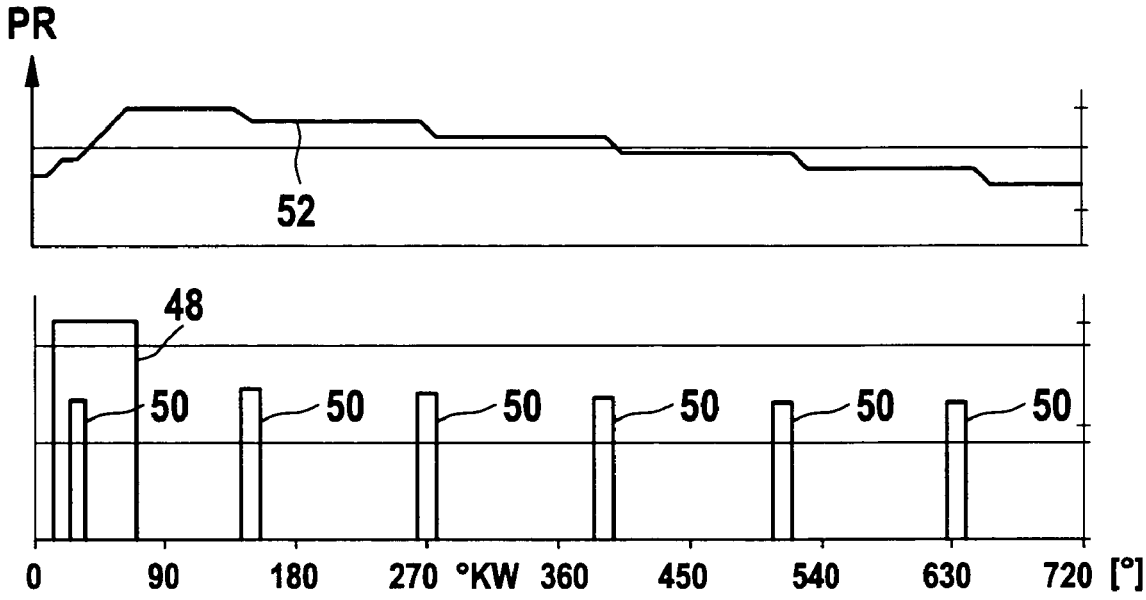
FIG. 3 is a chart similar to the chart shown in FIG. 2, for a second operating state of the internal combustion engine shown in FIG. 1.

FIG. 3 shows another operating situation of internal combustion engine 10. As can be seen from the width of injection phases 50, only a relatively small fuel quantity MI is injected into combustion chambers 32 in this case. Accordingly, the single supply phase 48 provided in this operating situation of internal combustion engine 10 per rotation of drive shaft 36 of supply unit 22, supplies only relatively little fuel. Supply phase 48 of FIG. 3 is thus considerably shorter than the supply phase 48 of FIG. 2. The pressure drop of pressure PR in fuel-collection line 28 during a working cycle, that is, two rotations of crankshaft 34, is correspondingly lower, too.

As a result, the precision in the metering of the fuel quantity into combustion chambers 32 is considerably better in the operating situation of FIG. 3 than in the operating situation of FIG. 2. Regardless of the temperature detected by sensor 40, a single supply phase 48 per rotation of drive shaft 36 could thus always be selected in those cases where only a relatively small fuel quantity MI is to be injected into combustion chambers 32 by fuel-injection devices 30. In many applications, however, a single supply phase 48 per rotation of drive shaft 36 is used only if overheating of the pump and the fuel is sought to be avoided, for instance; the supply rate is normally selected such that accurate metering is possible across the entire injection range.

Figure 4:
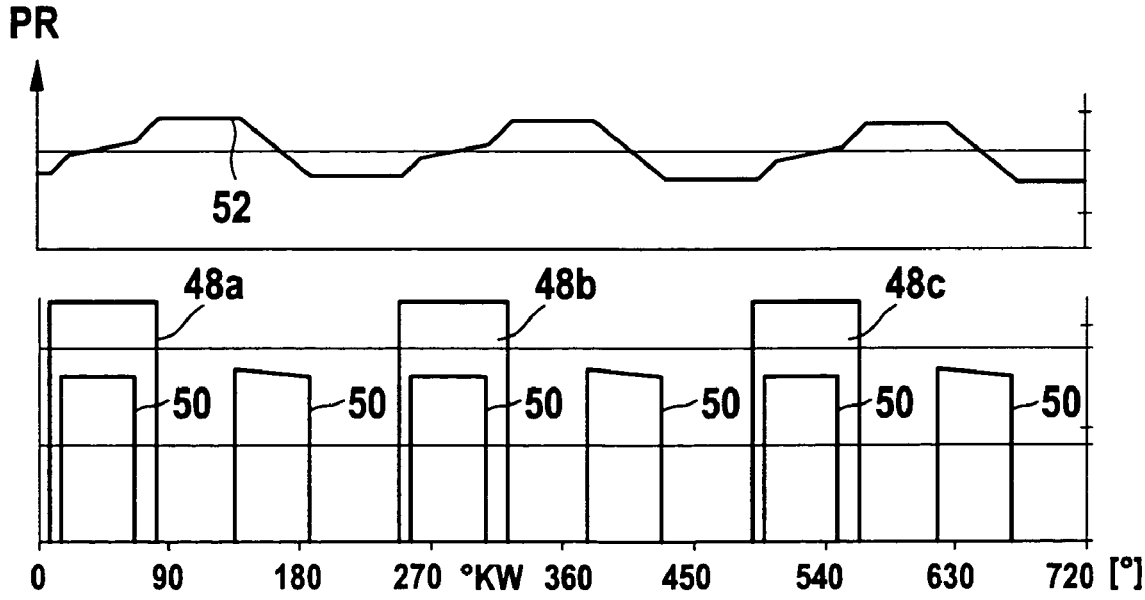
FIG. 4 is a chart similar to the chart shown in FIG. 2, for a third operating state of the internal combustion engine shown in FIG. 1.

Yet another, different operating situation is shown in FIG. 4. In this operating situation, a relatively large fuel quantity MI is to be injected by the fuel-injection devices into fuel-collection line 28; the cylinder-head temperature T, detected by sensor 40, is normal. In this case, a "triple supply" is provided, that is to say, a supply rate in which three supply phases 48*a*, 48*b* and 48*c* are provided per rotation of drive shaft 36. Supply phases 48*a*, 48*b* and 48*c* are evenly spaced within a working cycle of internal combustion engine 10. It can be seen that pressure PR in fuel-collection line 28 is comparatively stable despite the large injected fuel quantity MI.

Figure 5:
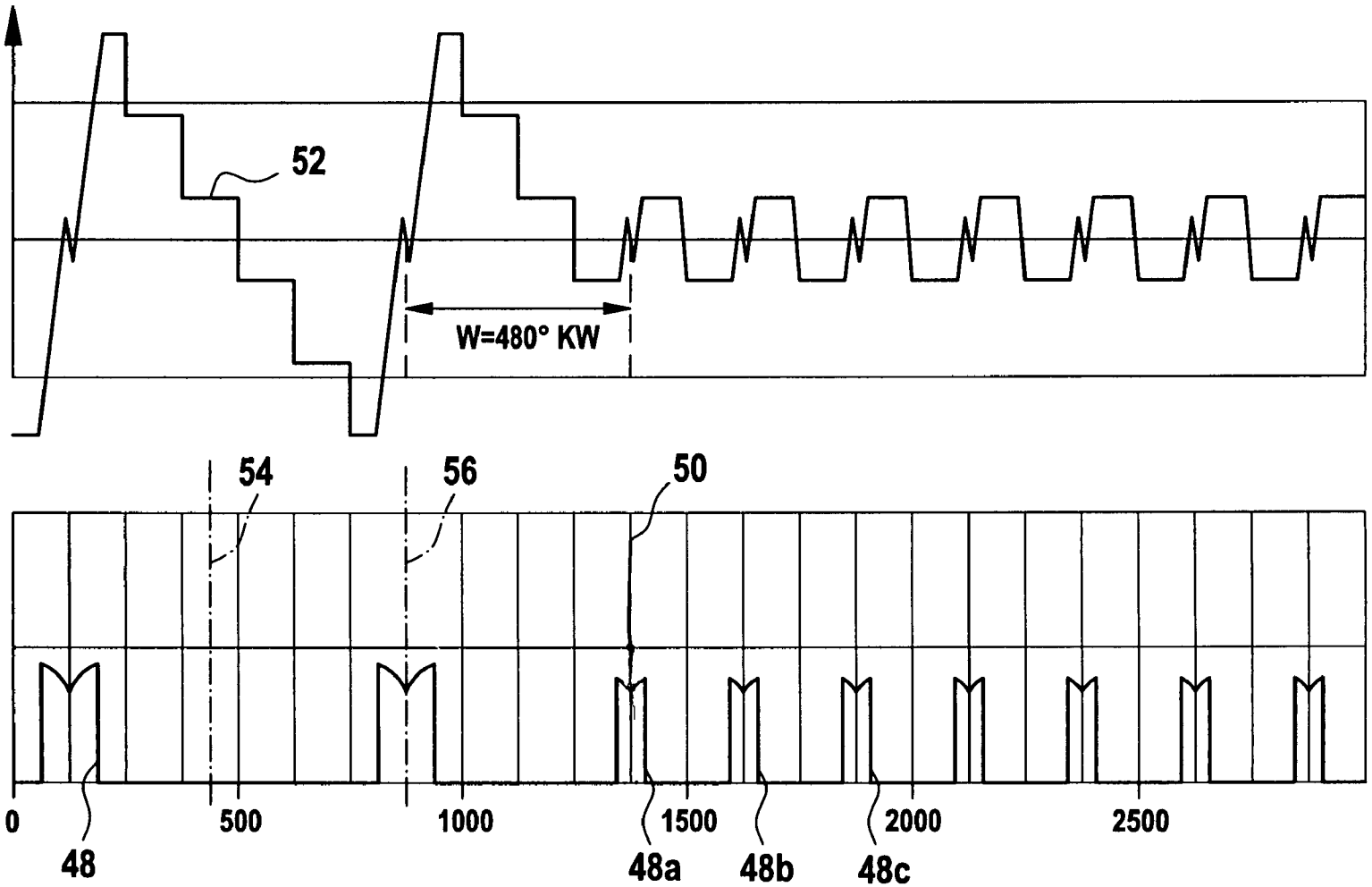

FIG. 5 shows a situation in which change from a supply rate having one supply phase 48 per rotation of drive shaft 36 to a supply rate having three supply phases 48*a*, 48*b* and 48*c* per rotation of drive shaft 36 takes place. A total of four working cycles, i.e., eight rotations of crankshaft 34 of internal combustion engine 10, are plotted. For reasons of clarity, only one injection pulse is provided with reference numeral 50. Injection pulses 50 themselves are only indicated by a line, for representational reasons, although in reality they correspond to an approximately acute delta pulse.

High-pressure fuel pump 18 initially operates at a supply rate of one supply phase 48 per rotation of drive shaft 36. Therefore, pressure PR in fuel-collection line 28 initially rises steeply and then drops again with each injection pulse 50 in a stepped manner.

Given a crank angle of approximately 450° (dot-dash line 54), control and regulating device 44 specifies on the basis of signals from sensors 40, 42 and 44 that the supply rate is to be increased to three supply phases 48*a*, 48*b* and 48*c* per rotation of drive shaft 36. However, this switch-over command 54 is not realized immediately, but only executed when the middle of next supply phase 48 has been reached. This is indicated by a dot-dash line 56 in FIG. 5. Accordingly, added to the instantaneous crank angle is a predefined waiting angle W which is determined according to the formula:

$$W = 720 * \frac{(X + Y)}{(2 * X * Y)}$$

where X=the supply rate prior to switching, and Y=the supply rate after switching. Waiting angle W thus amounts to 480° in the present six-cylinder internal combustion engine. First supply phase 48*a* of the supply rate having three supply phases 48*a*, 48*b* and 48*c* is now scheduled such that its middle lies in a crank angle of 480° following the middle of last supply phase 48 of the supply rate having only one supply phase.

Figure 6:
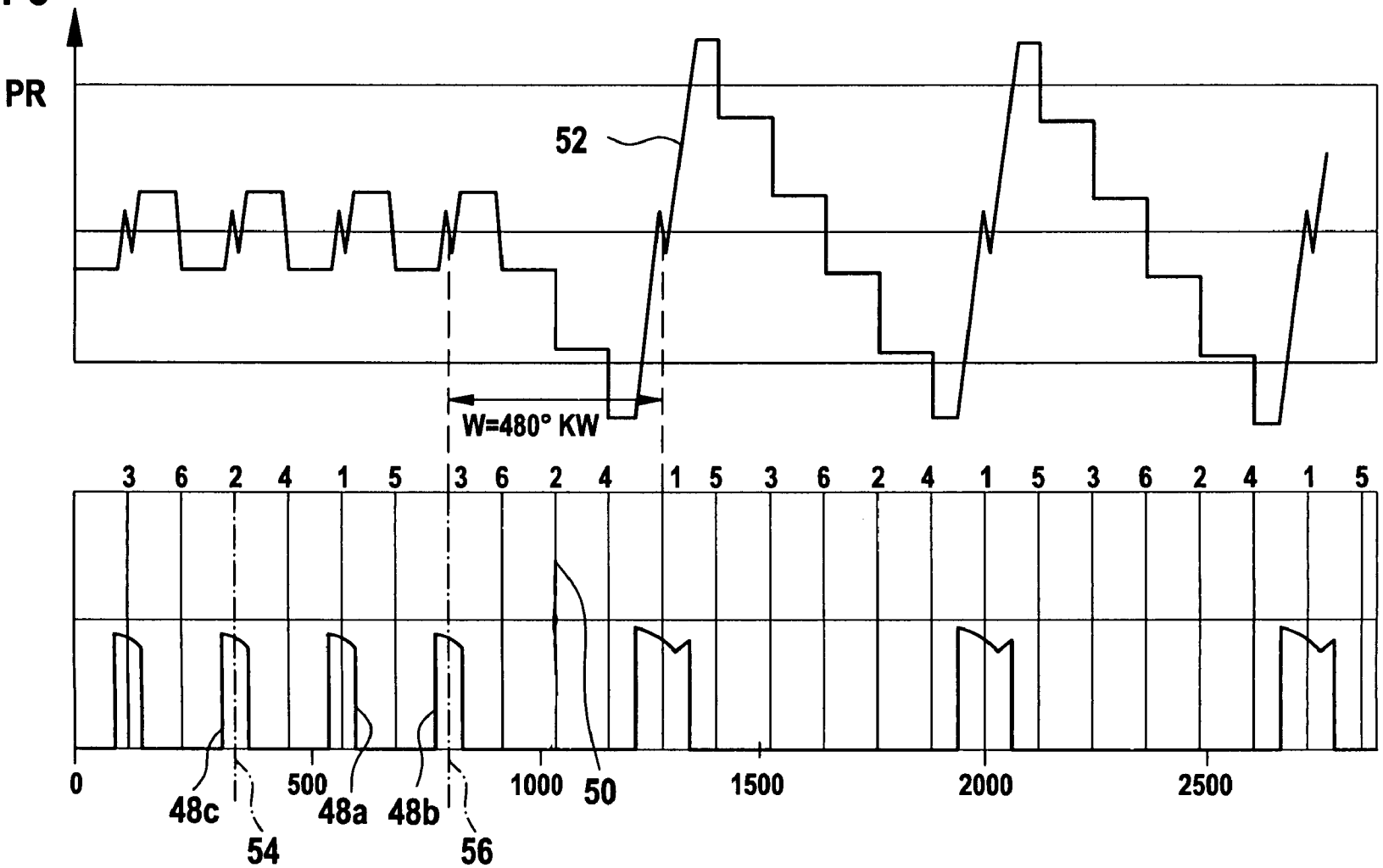

FIG. 6 shows how a switch is made from a supply rate having three supply phases per rotation of drive shaft 36 to a supply rate having only one supply phase 48 per rotation of drive shaft 36. Injection pulses 50 are additionally denoted by the number of the respective cylinder of internal combustion engine 10. The injection sequence, or ignition sequence, assumed in the present exemplary embodiment is thus 1-5-3-6-2-4. In principle, the switching occurs analogously to the method elucidated in connection with FIG. 5. In addition, it is taken into account that a single supply phase 48 per rotation of crankshaft 36 is allowed only at such angles of crankshaft 34 at which an injection is implemented into the cylinder bearing the number 1 by an injection pulse 50. Injection pulses 50, only one of which is provided with a reference numeral for reasons of clarity, are indicated by a line for representational clarity, although in reality they correspond to an approximately acute delta pulse.

Although a switching request 54 has already been detected during last supply phase 48*c* (injection pulse 50 into cylinder number 2), the actual switching (reference numeral 56) occurs only during the second subsequent supply phase 48*b* of the subsequent working cycle (injection pulse 50 into cylinder number 3).

For only then is it ensured that, taking waiting angle W of 480° crank angle into account, the individual supply phases 48 of the following, lower supply rate take place at a crank angle of crankshaft 34 at which injection occurs into the cylinder bearing the number 1. This angular position of individual supply phases 48 is required for control-technology reasons.

Figure 7:
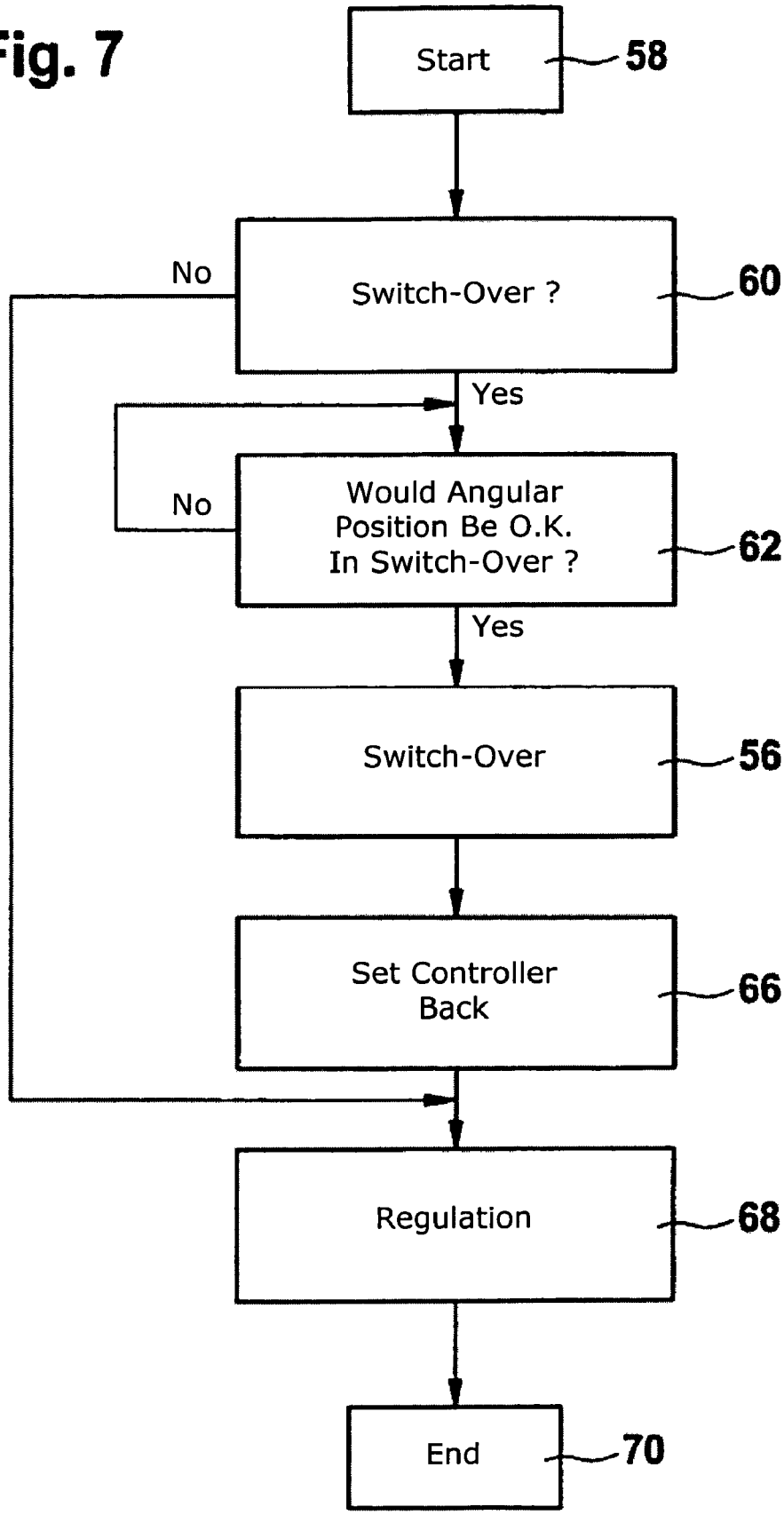
FIG. 7 is a flowchart illustrating a method by which the operation illustrated in FIG. 6 may be implemented.

FIG. 7 shows a flowchart of a method by which the switching shown in FIG. 6 may be implemented. Following a start block 58, it is first queried in a block 60 whether a change in the supply rate is desired. If the answer is "yes" in block 60 (this corresponds to the switching command denoted by 54 in FIG. 6), it is checked in block 62 whether a single supply phase is allowed at an angular position of crankshaft 34 that corresponds to the instantaneous angular position plus waiting angle W. Only when it is possible to answer "yes" to the query in block 62, does a switch occur in block 56 from the higher to the lower supply rate (this corresponds to dot-dash line 56 in FIG. 6). Since greater fluctuations in the fuel pressure in fuel-collection line 28 must now be expected, a controller by which the instantaneous fuel pressure in fuel-collection line 28 is corrected to a setpoint fuel pressure is set back in block 66. The actual regulation takes place in block 68. The method ends in block 70.

What is claimed is:

1. A method for operating an internal combustion engine having a fuel pump with a drive shaft, the fuel pump conveying fuel into at least one fuel-collection line, the fuel being subsequently conveyed to at least one combustion chamber via at least one fuel-injection device, the method comprising:

setting, by means of a valve device, a quantity of the fuel conveyed by the fuel pump into the fuel-collection line;

wherein the valve device is configured to selectively connect a discharge side of the fuel pump to a low-pressure region of the fuel pump, and wherein the valve device is configured to selectively disconnect the discharge side from the low-pressure region, and wherein, in supplying the quantity of fuel, a supply rate, defined as the number of supply phases of the fuel pump per rotation of the drive shaft, is determined as a function of at least one operating parameter of the internal combustion engine;

ascertaining at least one of (1) an interval between a first supply phase of a new supply-rate interval and a last supply phase of a preceding supply-rate interval, wherein a supply-rate interval is defined as an interval having a specific supply rate, and (2) a duration of the first supply phase of the new supply-rate interval; and changing the supply rate.

2. The method as recited in claim 1, wherein the middle of the last supply phase of the preceding supply-rate interval is spaced apart from the middle of the first supply phase of the new supply-rate interval by at least approximately a waiting angle W of a crankshaft of the internal combustion engine, wherein W is calculated according to the formula:

$$W=720*((X+Y)/(2XY)),$$

and wherein X is the supply rate before switching and Y=the supply rate after switching.

3. The method as recited in claim 2, wherein a change in the supply rate is allowed only when a supply phase is permitted at an angular position of the crankshaft that corresponds to a sum of the instantaneous angular position of the crankshaft and the waiting angle W.

4. A computer program stored on a computer readable medium and containing a plurality of computer-executable program codes for performing, when executed on a computer, a method for controlling an internal combustion engine having a fuel pump with a drive shaft, the fuel pump conveying fuel into at least one fuel-collection line, the fuel being subsequently conveyed to at least one combustion chamber via at least one fuel-injection device, the method comprising:

setting, by means of a valve device, a quantity of the fuel conveyed by the fuel pump into the fuel-collection line;

wherein the valve device is configured to selectively connect a discharge side of the fuel pump to a low-pressure region of the fuel pump, and wherein the valve device is configured to selectively disconnect the discharge side from the low-pressure region, and wherein, in supplying the quantity of fuel, a supply rate, defined as the number of supply phases of the fuel pump per rotation of the drive shaft, is determined as a function of at least one operating parameter of the internal combustion engine;

ascertaining at least one of (1) an interval between a first supply phase of a new supply-rate interval and a last supply phase of a preceding supply-rate interval, wherein a supply-rate interval is defined as an interval having a specific supply rate, and (2) a duration of the first supply phase of the new supply-rate interval; and changing the supply rate.

5. The computer program according to claim 4, wherein, in the method for controlling the internal combustion engine, the middle of the last supply phase of the preceding supply-rate interval is spaced apart from the middle of the first supply phase of the new supply-rate interval by at least approximately a waiting angle W of a crankshaft of the internal combustion engine, wherein W is calculated according to the formula:

$$W=720*((X+Y)/(2XY)),$$

and wherein X is the supply rate before switching and Y=the supply rate after switching.

6. A computer-readable storage medium for storing a computer program containing a plurality of computer-executable program codes for performing, when executed on a computer, a method for controlling an internal combustion engine having a fuel pump with a drive shaft, the fuel pump conveying fuel into at least one fuel-collection line, the fuel being subsequently conveyed to at least one combustion chamber via at least one fuel-injection device, the method comprising:

setting, by means of a valve device, a quantity of the fuel conveyed by the fuel pump into the fuel-collection line;

wherein the valve device is configured to selectively connect a discharge side of the fuel pump to a low-pressure region of the fuel pump, and wherein the valve device is configured to selectively disconnect the discharge side from the low-pressure region, and wherein, in supplying the quantity of fuel, a supply rate, defined as the number of supply phases of the fuel pump per rotation of the drive shaft, is determined as a function of at least one operating parameter of the internal combustion engine;

ascertaining at least one of (1) an interval between a first supply phase of a new supply-rate interval and a last supply phase of a preceding supply-rate interval, wherein a supply-rate interval is defined as an interval having a specific supply rate, and (2) a duration of the first supply phase of the new supply-rate interval; and changing the supply rate.

7. The computer-readable storage medium according to claim 6, wherein, in the method for controlling the internal combustion engine, the middle of the last supply phase of the preceding supply-rate interval is spaced apart from the middle of the first supply phase of the new supply-rate interval by at least approximately a waiting angle W of a crankshaft of the internal combustion engine, wherein W is calculated according to the formula:

$$W=720*((X+Y)/(2XY)),$$

and wherein X is the supply rate before switching and Y=the supply rate after switching.

8. A control device for an internal combustion engine having a fuel pump with a drive shaft, the fuel pump conveying fuel into at least one fuel-collection line, the fuel being subsequently conveyed to at least one combustion chamber via at least one fuel-injection device, comprising:

an arrangement for setting, by means of a valve device, a quantity of the fuel conveyed by the fuel pump into the fuel-collection line;

wherein the valve device is configured to selectively connect a discharge side of the fuel pump to a low-pressure region of the fuel pump, and wherein the valve device is configured to selectively disconnect the discharge side from the low-pressure region, and wherein, in supplying the quantity of fuel, a supply rate, defined as the number of supply phases of the fuel pump per rotation of the drive shaft, is determined as a function of at least one operating parameter of the internal combustion engine;

an arrangement for ascertaining at least one of (1) an interval between a first supply phase of a new supply-rate interval and a last supply phase of a preceding supply-rate interval, wherein a supply-rate interval is defined as an interval having a specific supply rate, and (2) a duration of the first supply phase of the new supply-rate interval; and an arrangement for changing the supply rate.

9. The control device as recited in claim 8, wherein the middle of the last supply phase of the preceding supply-rate interval is spaced apart from the middle of the first supply phase of the new supply-rate interval by at least approximately a waiting angle W of a crankshaft of the internal combustion engine, wherein W is calculated according to the formula:

$$W=720*((X+Y)/(2XY)),$$

and wherein X is the supply rate before switching and Y=the supply rate after switching.

10. The control device as recited in claim 9, wherein a change in the supply rate is allowed only when a supply phase is permitted at an angular position of the crankshaft that corresponds to a sum of the instantaneous angular position of the crankshaft and the waiting angle W.

* * * * *

UNITED STATES PATENT AND TRADEMARK OFFICE

CERTIFICATE OF CORRECTION

PATENT NO. : 7,568,468 B2
APPLICATION NO. : 10/813853
DATED : August 4, 2009
INVENTOR(S) : Wolber et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1215 days.

Signed and Sealed this

Seventh Day of September, 2010

David J. Kappos

David J. Kappos
*Director of the United States Patent and Trademark Office*